United States Patent [19]

Willis

[11] 4,200,100

[45] Apr. 29, 1980

[54] ADDITIVE TRANSFER UNIT WITH PIERCING MEMBER HAVING A PENETRATABLE PROTECTIVE TIP

[75] Inventor: Wilburn C. Willis, Hagerstown, Ind.

[73] Assignee: Aluminum Company of America, Pittsburgh, Pa.

[21] Appl. No.: 898,157

[22] Filed: Apr. 20, 1978

[51] Int. Cl.[2] ..... A61J 1/00

[52] U.S. Cl. ..... 128/272.3; 215/253; 128/347; 222/541

[58] Field of Search ..... 128/272, 272.1, 272.3, 128/216, 347, 220, 221; 215/252, 253; 222/541, 566, 568

[56] References Cited

U.S. PATENT DOCUMENTS

| | | | |
|---|---|---|---|
| Re. 29,656 | 3/1977 | Chittenden | 128/272.3 |
| 2,604,685 | 7/1952 | Harms | 128/347 |
| 2,957,501 | 10/1960 | Holmes | 141/2 |
| 3,055,367 | 9/1962 | Thorstad | 128/272 |
| 3,066,671 | 12/1962 | Cohen | 128/272 |
| 3,096,763 | 7/1963 | McConnaughey | 128/221 |
| 3,330,281 | 7/1967 | Visser | 128/272.1 |
| 3,633,580 | 1/1972 | Knox | 128/221 |
| 3,923,059 | 12/1975 | Ogle | 128/237 |
| 3,948,266 | 4/1976 | Clark et al. | 128/272 |
| 3,987,791 | 10/1976 | Chittenden | 128/272.3 |
| 4,010,747 | 3/1977 | Clark et al. | 128/173 H |
| 4,020,839 | 3/1977 | Klapp | 128/272 |

FOREIGN PATENT DOCUMENTS

| | | | |
|---|---|---|---|
| 218169 | 1/1958 | Australia | 128/272 |
| 2245121 | 4/1973 | Fed. Rep. of Germany | 215/253 |
| 2500073 | 7/1976 | Fed. Rep. of Germany | 128/221 |

*Primary Examiner*—Robert W. Michell
*Assistant Examiner*—J. L. Kruter
*Attorney, Agent, or Firm*—David J. Hill; Glenn E. Klepac

[57] ABSTRACT

An additive vial for transferring a liquid medicament into an evacuated container is disclosed comprising a liquid medicament storage container having a neck terminating at a generally flat-rimmed bead defining a mouth opening in the container. Closing the mouth of the container is a rigid disc, having a hollow, generally cylindrical piercing member extending outwardly from a central location of the disc terminating in a needle point. An elastic sealing means is provided around and contiguous an outer portion of the container rim. The sealing means also overlies an outer peripheral portion of the exterior surface of the disc with respect to the exterior of the container. A penetrable tip is provided over the needle point of the piercing member, and a removable, outwardly projecting cylindrical portion of a closure extends over and around the tip covering the needle point. The closure also includes an annular rim at least partially overlying an outer peripheral portion of the disc and the sealing means, and a depending skirt extending downwardly from the annular rim having the lower portion turned inwardly under and against the container bead to constrict the sealing means and the disc toward the rim effectuating a seal about the rim of the container.

26 Claims, 9 Drawing Figures

ADDITIVE TRANSFER UNIT WITH PIERCING MEMBER HAVING A PENETRATABLE PROTECTIVE TIP

BACKGROUND OF THE INVENTION

1. Field of Invention

The present invention pertains to a new and improved additive vial used to transfer liquids into a container. More particularly, this invention relates to an additive vial which is useful in quickly and efficiently transferring medicinal solutions into evacuated containers of intravenous or intramuscular solution or the like.

2. Description of the Art

Bottles of parenteral solution are typically shipped to the administering institution, such as a hospital, in bulk quantity. For efficiency in production, transfer and storage of such bottles, the chemical composition of the parenteral solution is uniform, bottle to bottle, and is not subjected to degradation or contamination solely on account of the age of the solution. However, the chemical composition of the solution administered to the end user, such as a patient, must be tailored according to the individual needs of the user. For example, a patient to be administered a standard intravenous solution, such as distilled water with five percent (5%) glucose, may require a quantity of vitamins, minerals, serums, such as sodium pentothal, or other drugs to be added to the parenteral solution for concurrent intravenous administration.

Medicinal additives have a tendency to degrade over a period of time and, therefore, are preferably added to the intravenous solution just prior to administration to a patient. The additives are typically packaged in five milliliter glass vials provided with a closure having a removable top portion and a hollow spike having both ends sharpened. After removal of the top portion and upon the application of force against the rubber diaphragm of the parenteral solution container, one end of the spike penetrates the container while the other end of the spike substantially simultaneously penetrates a puncturable seal provided on the vial. A vacuum maintained in the parenteral solution container pulls the additive solution therein through the hollow passageway provided in the spike.

The assembly of the closure system for the vials of the prior art is complex. Initially, all of the closure components are usually preassembled before the closure is mounted onto the container. In such preassembly, a double-edged, hollow spike provided with an outwardly projecting rim, auxiliary core slides and the like, is inserted into a rubber stopper until the rim locks into a groove provided in the stopper. The rubber stopper is closed at the end opposite the exposed spike. A first ferrule, designed to hold the stopper onto the vial, is placed over the exposed spike and against a ledge provided on the rubber stopper. A removable overcap is placed over the exposed spike and fits tightly against the rubber stopper. A second metal ferrule, which is removable and is designed to hold the overcap onto the vial, is placed over the overcap and over the first ferrule. The preassembled closure is placed over the mouth of a vial and both ferrules are simultaneously constricted under the bead at the mouth of the vial in one rolling operation.

After the closure and vial are assembled, the assembly must be sterilized. The most common method of sterilization is by exposing the parts to a pressurized steam atmosphere, at a temperature of about 250° F. (120° C.). The cavity surrounding the spike in the closure of the prior art is air tight. In order to insure that steam will be present in such cavity during heating and pressurization, it is necessary to assembly the closure parts in a wet condition. Manual wet assembly is a complicated process. The assembly of such closure systems typically adds significantly to the overall cost of the additive vial.

The vials of the prior art are typically provided with an overcap which is removable by a multiple step process. For example, it is common to have a tear-off ring provided on the top of the vial which must be pulled to sever the ring and thereby render the ring removable. Thereafter, the ring is pulled or unwrapped from the vial to free the removable overcap. The overcap may then be lifted from the vial in order to gain access to the spike.

Upon removal of the overcap from the vials of the prior art, the spike or needle is exposed. Such exposure may cause contamination from the atmosphere.

A significant technical weakness of the vials of the prior art is that during penetration of the spike of the vial into the parenteral solution container, air may be drawn into the parenteral solution. Such air is drawn by the vacuum maintained in the parenteral solution container at locations around the spike, which are characterized by uneven spike penetration.

Accordingly, an improved additive vial is desired which is characterized by relatively simple, yet efficient, construction, assembly and operation. In particular, such improved additive vial should consist of relatively few parts, will have a compact construction and should prevent leakage and minimize contamination during transfer of its contents to an evacuated parenteral solution container.

SUMMARY OF THE INVENTION

This invention may be summarized as providing an improved additive vial for transferring liquid medicament into an evacuated container. Such vial comprises a liquid medicament storage container having a neck terminating at a generally flat-rimmed bead defining a mouth opening in the container. Closing the mouth of the container is a rigid disc, having a hollow, generally cylindrical piercing member extending outwardly from a central location of the disc terminating in a needle point. An elastic sealing means is provided around and contiguous an outer portion of the container rim. The sealing means also overlies an outer peripheral portion of the exterior surface of the disc with respect to the exterior of the container. A penetrable tip is provided over the needle point of the piercing member, and a removable, outwardly projecting cylindrical portion of a closure extends over and around the tip covering the needle point. The closure also includes an annular rim at least partially overlying an outer peripheral portion of the disc and the sealing means, and a depending skirt extending downwardly from the annular rim with its lower portion turned inwardly under and against the container bead to constrict the sealing means and the disc toward the rim effectuating a seal about the rim of the container.

Among the advantages of the present invention is the provision of a new and improved, compact additive vial comprised of relatively few parts which aid in assembly of the vial, whether manual or automated, and reduce its overall cost.

Another advantage of the present invention is the provision of an improved additive vial which maximizes sterility throughout transfer of the medicament therein, and, more particularly, prevents air from being drawn into the bottle of parenteral solution around the needle during such transfer.

An objective of the present invention is to provide a compact, low cost, additive vial which operates simply and efficiently.

Another objective of the present invention is to provide an improved additive vial in which the interior and exterior surfaces of the needle may be steam sterilized after assembly without having to add water to the assembled components.

The above and other objectives and advantages of this invention will be more thoroughly understood and appreciated with reference to the following description and the drawings appended hereto.

Description of the Preferred Embodiments

Figure 1:
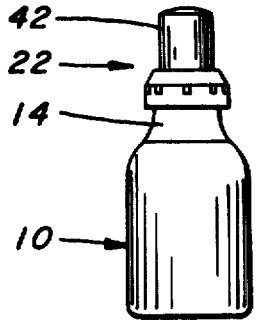
FIG. 1 is a side elevational view of the additive vial of the present invention.
Figure 2:
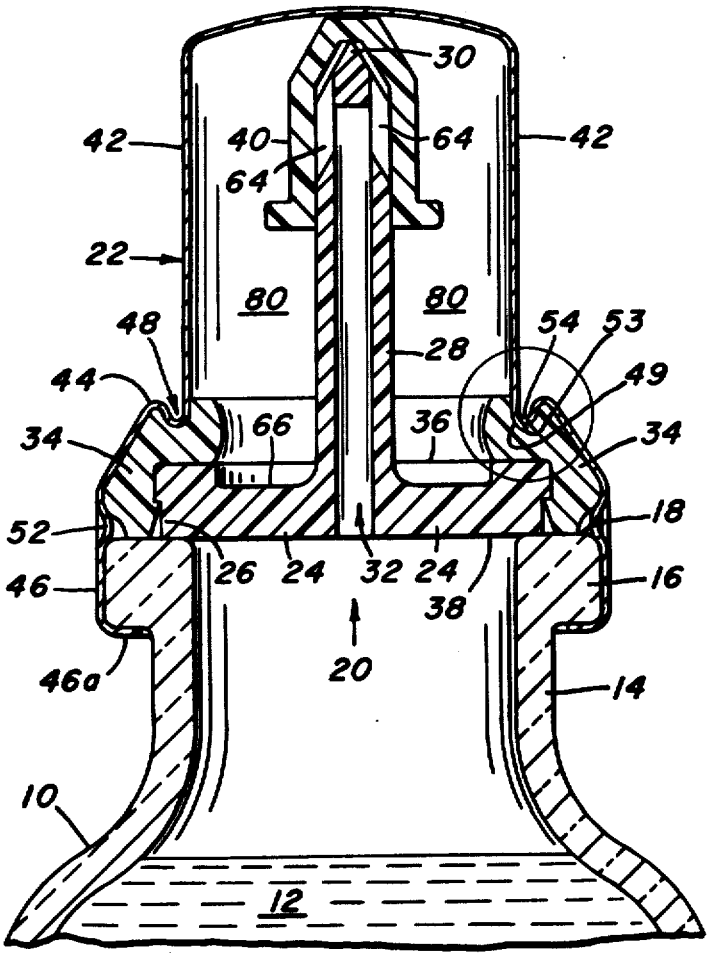
FIG. 2 is a cross-sectional view of an additive vial of the present invention through a top portion of the vial shown in FIG. 1.

Referring particularly to the drawings, FIGS. 1 and 2 illustrate a preferred additive vial of the present invention. The vial shown in FIGS. 1 and 2 includes a liquid storage container 10 for holding a medicament 12 to be transferred. The storage container has a neck portion 14 which terminates in a bead 16. The bead 16 is preferably provided with a generally planar rim 18, and the inside dimension of the rim defines the circumference of a mouth opening 20 in the container 10.

The liquid storage container 10 is preferably constructed of glass for sterility purposes, but may also be constructed of plastic, metal or any other material that will support the closure system 22 described below. It will be understood that the container 10 may also be constructed of a flexible material which may aid in manual transfer of its contents by compression of its sidewalls in instances where the receiving container is not sufficiently evacuated to receive such contents without external aid. Typically, transfer vials are sized to hold enough liquid medicament to efficiently transfer five milliliters. It will be understood that vials of any size are comprehended by the present invention, and that vials are typically overfilled to compensate for the product remaining after the desired amount has been transferred. Also, a relatively large headspace of air is required to be maintained in the filled vial to insure that adequate air is available to force the contents of the vial into an evacuated parenteral solution container.

Typical additive solutions include sodium bicarbonate, antibiotics, anticoagulants and a variety of vitamins and minerals.

Referring again to FIGS. 1 and 2, a disc 24 of rigid material, such as plastic, closes the mouth 20 of the container 10. A peripheral portion 26 of the disc 24 overlies at least a portion, and preferably at least one-third, of the rim 18 of the container 10. A portion of the inner surface 38 of the disc 24 may also fit into the mouth of the container 10. In a preferred embodiment, the disc 24 is in contact with the inner circumferential portion of the rim 18 of the container 10. A generally cylindrical, rigid piercing member 28 or spike extends from a central location of the disc 24 in a direction outwardly of the mouth 20 of the container 10 terminating in a needle point 30. The piercing member 28 must be sufficiently rigid to withstand insertion through a sealing member, such as a rubber seal, closing the mouth of an intravenous bottle or the like, without cracking or breaking. Plastic has been found to be the preferred material for the piercing member 28 and the disc 24. Though not required, it has also been found that the disc 24 and the piercing member 28 should be cast as an integral unitary construction.

In the vial of the present invention, an aperture 32 extends from the needle point 30, generally through the longitudinal axis of the piercing member 28 and continues through the disc 24 along such axis to define a passageway from the interior of the container 10 to the exterior of the container 10.

A portion of an elastic sealing member 34 is provided around and contiguous the outside diameter of the disc 24 to assist in providing an air-tight seal for the vial. A portion of the sealing member 34 preferably overlies at least an outer peripheral portion of the rim 18 of the container. Further, the sealing member 34 preferably overlies an outer peripheral portion 26 of disc 24 along the exterior surface 36 of the disc 24. It should be understood that the disc 24 has exterior and interior surfaces 36 and 38, respectively, with respect to the exterior and interior of the container 10.

Figure 3:
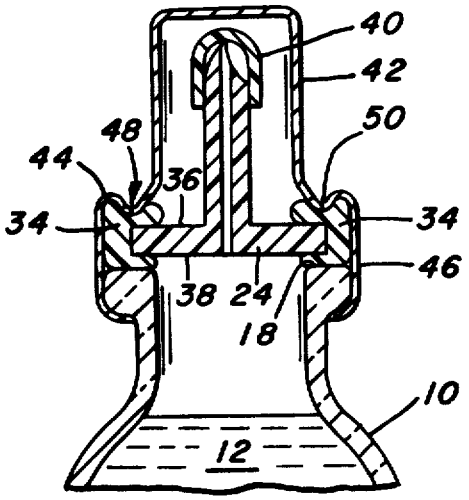
FIG. 3 is a cross-sectional view of an alternative additive vial of the present invention through a top portion of the vial shown in FIG. 1.

In an alternative embodiment, the elastic sealing member 34 may also underlie an outer peripheral portion of the interior surface 38 of the disc 24. This embodiment is illustrated in FIG. 3. Such a provision could aid in efficient sealing, especially where the rim 18 of the container 10 or the interior surface 38 of the disc 24, or both, are provided with irregular finish that could not otherwise be provided with an effective hermetic seal.

The needle point 30 of the piercing member 28 is covered with a protective tip 40. The tip is preferably elastic, and in one embodiment of the present invention, as illustrated in FIG. 2, is fit tightly over all of the slots 64 provided in the needle point 30 in order to isolate the passageway 32 therethrough and to provide an hermetic seal for the container 10 under normal conditions. The protective tip 40 must be readily penetrable by the needle point 30.

Figure 4:
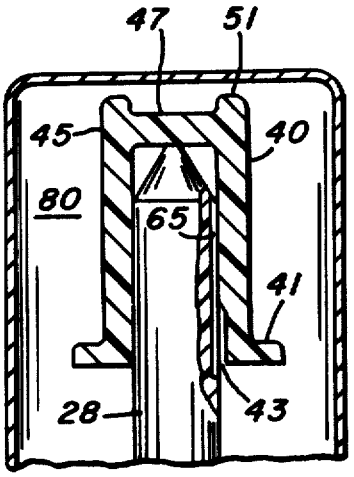
FIG. 4 is a partial cross-sectional view of a portion of a preferred vial closure.

In a preferred embodiment as illustrated in FIG. 4, the protective tip 40 should be so flexible that a bottom portion 41 of the tip 40 would deflect in a direction away from the slots 64 in the needle point 30 in response to a positive pressure differential of approximately 20 to 30 pounds per square inch (137.9 to 206.8 kilopascals) inside the vial. Such embodiment permits dry assembly of the vial yet assures steam sterilization of the cavity 80 surrounding the piercing member 28. By heating the assembled vial of the present invention, a portion of the solution vaporizes and creates a pressure inside the vial greater than the pressure in the cavity 80. When such pressure differential reaches about 20 to 30 pounds per square inch (137.9 to 206.8 kilopascals), the pressurized vapor in the vial vents into the cavity 80 through the passageway 43 created under the protective tip 40. During such venting a small quantity of vapor will pass into the cavity adequate to effectuate steam sterilization of the cavity 80. Such embodiment eliminates the necessity of wet assembly of the closure parts. It will be further understood that little or no pressure differential is necessary to permit gaseous communication through the groove 65 at a location below the protective tip 40. As explained below, such groove 65 is sized to prevent the passage of liquid therethrough under normal conditions.

The preferred construction for the protective tip 40 is illustrated in FIG. 4. Preferably the upper portion 45 of the tip 40 has a generally planar top surface 47 and is preferably provided with an outer peripheral ring-shaped surface 51. As explained in more detail below, such ring-type construction insures that a seal is maintained around the needle 28 as the vial contents are being transferred into a parenteral solution container.

In the vial of the present invention, the needle point 30 of the piercing member 28 may have any construction. A common needle construction is shown by the needle point 30 of FIG. 6, wherein a downwardly angular, approximately 45°, cross-cut of the piercing shaft 28 produces a spike or needle point 30 having a high point 62 located at one location on a sidewall, with the cross-cut extending downwardly therefrom. The passageway 32 through such needle extends completely through the longitudinal axis of the piercing member 28.

Figure 5B:
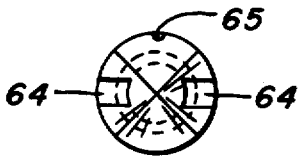
FIG. 5*b* is a top elevation view of the needle shown in FIG. 5*a*.
Figure 5A:
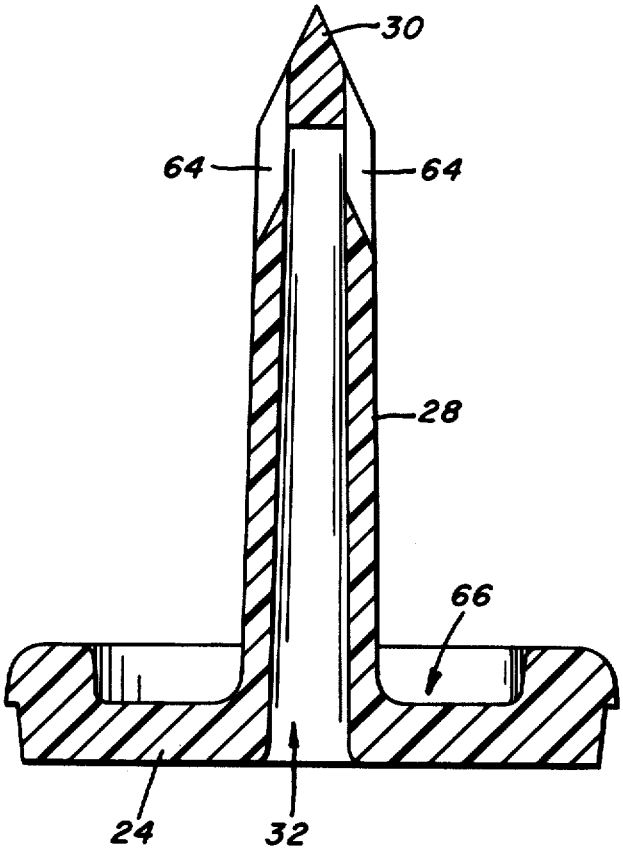
FIG. 5*a* is a cross-sectional view of a needle portion of the vial illustrated in FIG. 2.

A preferred needle construction is shown by the needle point of FIG. 2 and shown alone in more detail in FIG. 5*a*. Such preferred needle point 30 is generally pyramid-shaped having four, equally spaced, sharp corners. It will be understood that three, five or six corners may also be provided by similar or equivalent design. In the pyramid-shaped needle 30 shown in FIGS. 2, 4 and 5, the high point 30 is located centrally of the piercing shaft 28. The point 30 is closed in this embodiment to provide for its sharpening. The passageway 32, therefore, extends through the longitudinal axis of the piercing member 28 to a location near the point 30 and a plurality of slots 64, preferably two oppositely disposed slots 64, are provided in the sharpened walls defining point 30 to provide gaseous communication to the exterior of the container 10. Another construction method which permits steam to vent from beneath the protective tip 40 is shown in FIG. 4 and in FIG. 5*b*. A small capillary passage, such as the groove 65, may be provided through the sidewall of the spike 28. Such small passage should be sized such that air and gas, such as steam, may pass therethrough at low, or even zero, pressure, yet the unpressurized liquid may not pass therethrough during normal handling of the vial. The diameter of such groove is preferably 0.005 to 0.010 inch (0.127 to 0.254 mm) which prevents the passage of liquid therethrough under normal conditions because of the surface tension of the liquid. It will be understood that appropriate slits or tapered passages, either through the needle or through the tip 40 covering the needle, may also serve to vent air, steam or other gases therethrough.

The tip 40 covering the needle point 30 should extend completely over the slots 64. It will be understood by those skilled in the art that upon penetration of such needle 30 into the elastic tip 40 and into a penetrable seal on a parenteral solution bottle, the four sharp corners create a high tear stress along their respective edges causing the penetrable material to tear substantially uniformly. Thus, rather than having one large, non-uniform tear, four small, controlled tears result in forming a substantially even X-shape in the target area of the penetrable material.

When a liquid impervious opening, such as the groove 65 is provided, the protective tip 40 should cover all but a portion of such groove 65. During medicament transfer, the uncovered portion of the groove 65 should become sealed or covered by the bottom portion 41 of the protective tip 40 before the slots 64 pass through the top portion 45 of the protective tip 40. Otherwise, there would be a gaseous passageway to the bottle of parenteral solution that could eliminate or reduce the vacuum pressure maintained therein and possibly permit atmospheric contamination of the medicament.

A closure 22, preferably constructed of aluminum, is provided over the disc 24, the piercing member 28 and the sealing member 34 and 40 to hold the parts in place and to protect the piercing member 28. The closure 22 has an outwardly projecting, cylindrical portion 42 extending over and around the piercing member 28. This outwardly projecting, cylindrical portion 42 is manually removable, as will be explained in detail below, and also serves as a tamper-proof seal. At the base of the cylindrical portion 42 is an annular rim 44 extending generally outwardly and overlying an outer peripheral portion of the disc 24 and the sealing member 34. As discussed below, a seal 49 is usually required along the annular rim 44 at or near the base of the removable top portion 42. A depending skirt 46 extends downwardly from the annular rim 44 of the closure. A lower portion 46*a* of the skirt 46 is turned inwardly under and against the container bead 16 around the periphery of the container mouth 20. Such inward deformation of the closure skirt 46 constricts the elastic sealing member 34 and the disc 24 toward the rim 18 of the container 10. Inward deformation of the closure skirt 46 under the bead 16 in combination with the seal 49 at the base of the top portion 42 effectuates an hermetic seal about the rim 18 of the container 10.

In a preferred embodiment, a circular portion 48 of the annular rim 44, which overlies the outer peripheral portions 26 of the disc 24 and the sealing member 34, is indented toward the sealing member 34 and the disc 24, thereby providing a seal 49 beginning at the location of the indentation 48 and extending outwardly and downwardly along the annular rim 44 and closure skirt 46 to the rim 18 of the container. Such seal is also maintained around the circumference of the rim 44. This indenting action also assists in constricting the elastic sealing member 34 and the disc 24 toward the rim 18 of the container 10, and thereby assists in maintaining the hermetic seal about the rim 18 of the container 10. Tests have shown that the seal about the rim 18 of the vial of the present invention is maintained without leakage at pressure in excess of 60 pounds per square inch (413.7 kilopascals). Such excessive pressures should never be experienced by additive vials in routine practice.

One mode of rendering the outwardly projecting, cylindrical portion 42 removable is to provide a circular score line 50 around the circumference of the rim 44 of the closure 22. As shown in FIG. 3, such score 50 is preferably provided at a sufficient depth, such as at least 50% of the metal thickness, to permit manual removal of the cylindrical portion 42, yet prevent the passage of air therethrough until separation.

However, the preferred method of rendering the outwardly projecting portion 42 removable is to provide a series of lanced portions 53 interrupted by a series of preferably equally spaced bridges of metal 54 around the circumference of the rim 44 of the closure 22. The lanced portions 53, which would extend completely through the metal at the same location as the above-discussed score line 50, are more controllable in production than are score lines 50. It will be understood that where the lance portions 53 and bridge 54 method is used, an air-tight seal 49 must be provided under the lances 53 to prevent the passage of air therethrough. Such seal 49 is readily provided by the inward indentation 48 discussed above.

Where the annular rim 44 of the closure 22 is provided with an inward indentation 48, it is preferable to provide the lances 53 and bridges 54 or the score line 50 at a location at or near the base of the indentation 48. Such location of the lances 53 or the score line 50 insures not only that a seal 49 is maintained at the indentation 48 but also that the depending skirt 46 remains solidly in position after the cylindrical portion 42 has been removed. It will be understood, however, that the score 50 may be provided at any location, preferably on or near the annular rim 44, as long as the depending skirt 46 remains in position after the cylindrical portion 42 is removed. Such score 50 may also be provided on the cylindrical portion 42 at or near the base of the cylindrical portion 42, but the amount of metal extending outwardly of the annular rim 44 of the closure 22 after removal of the portion 42 should be minimized to insure maximum, unobstructed penetration of the piercing member 28 when transferring medicament 12.

The depending skirt 46 may further be crimped inwardly, such as illustrated by reference number 52. Such crimping may be intermittent or continuous about the circumference of the depending skirt 46. Inward crimping of the skirt 46 may assist in providing a mechanical means of locking the sealing member 34 and the disc 24 into the closure 22 prior to application of the closure 22 to the container 10.

In a preferred embodiment of the vial of the present invention, the exterior surface 36 of the disc 24 is provided with a recess 66 about the piercing member 28. Such recess 66 is preferably ring-shaped and is centrally provided in the exterior surface 36 of the disc 24 around and substantially concentric with the piercing member 28. Such recess 66 provides room within which the elastic tip 40 may be compressed as the piercing member 28 is inserted into the stopper of an intravenous container or the like. Providing such recess 66 insures that the piercing member 28 may be inserted into a bottle of parenteral solution at a maximum depth with minimum interference from displacement of the elastic tip 40 as it slides downwardly of the piercing shaft 28 during insertion.

Figure 6:
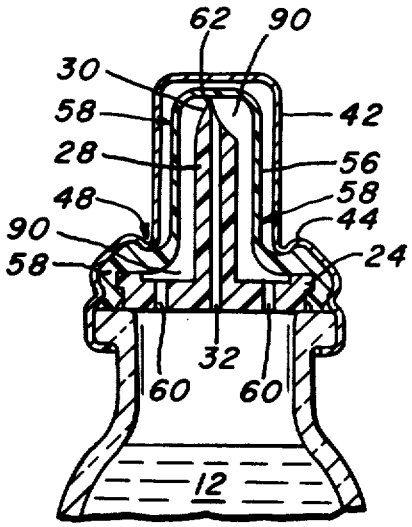
FIG. 6 is a cross-sectional view of an alternative additive vial of the present invention through a top portion of the vial shown in FIG. 1.

In another embodiment of the present invention, as illustrated in FIG. 6, the elastic sealing member 34 and the elastic tip 40 are connected by a flexible cylindrical wall 56 to comprise an integral unitary sealing member. In this embodiment, the tip does not fit tightly over the needle point 30. Such tight fit is not necessary to maintain an hermetic seal with this embodiment. Furthermore, a space is maintained between the outwardly projecting cylindrical portion of the closure and the flexible walls 56 of the unitary sealing member 58. In this embodiment, illustrated in FIG. 6, a series of vent holes 60 may be provided through the disc 24. As shown in FIG. 3, the unitary sealing member 58 completely surrounds the disc 24 and the piercing member 28 to effectively isolate the contents 12 of the vial from the atmosphere whether through the passageway 32 or through the vents 60.

Additive vials of the prior art typically had to be manually assembled wet, under clean conditions in a sterile environment. The moisture trapped between the parts would vaporize and thereby sterilize the vial cavities when the entire package was pasteurized. Such expensive steps are eliminated by the present invention.

The cavity 80 between the outside of the needle and the inside of the cylindrical portion 42 of the vial of the present invention may be sterilized by steam vapor. In utilizing a vial of the present invention, such steam vapor is able to vent from under the elastic sealing tip 40. As discussed above, such venting is possible because the vapor pressure inside the vial at temperatures experienced during the retort cycle is greater than the pressure in the cavity 80 outside the piercing member 28. Such simplification in sterilization methods has a unique, economical advantage over the wet assembly of vials of the prior art.

In the operation of the vial of the present invention, the outwardly projecting, cylindrical portion 42 is manually removed from the vial. Removal of the cylindrical portion 42 may be readily accomplished by pushing against the cylindrical portion 42 with the thumb or forefinger or both, causing the score line 50 or the bridges of metal 54 at the base thereof to fracture. A subsequent pulling or twisting action against the cylindrical portion 42 completely separates the portion 42 from the vial.

After the cylindrical portion 42 has been removed from the vial, the needle 30 of the piercing member 28, and thus the contents of the vial, are not exposed to contamination from the atmosphere because the neelde 30 and the passageway through the piercing member 28 remain covered and protected by either an elastic tip 40 or a unitary sealing member 58.

Figure 7:
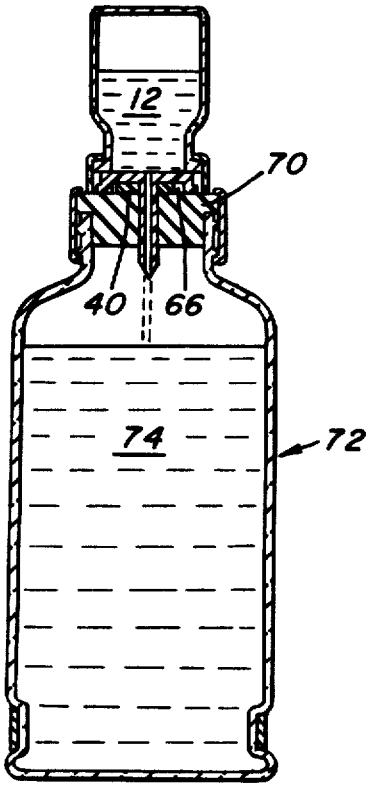
FIG. 7 is a cross-sectional view of an additive vial of the present invention having been inserted through a stopper of a bottle of parenteral solution.
Figure 8:
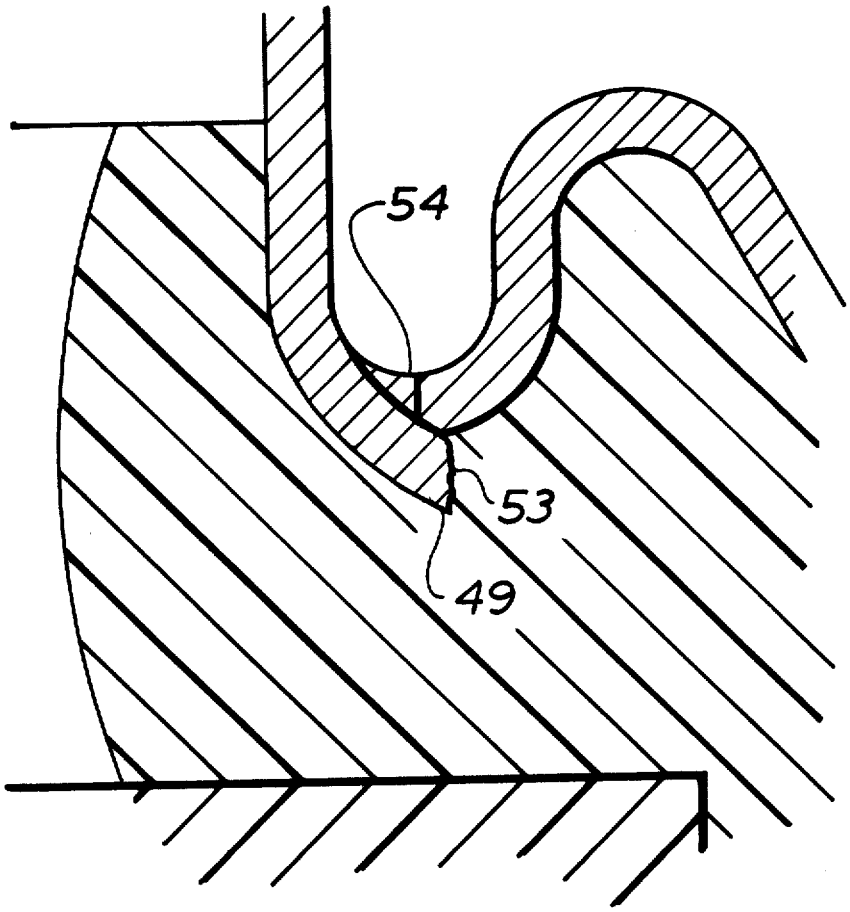
FIG. 8 is an enlarged, fragmentary view of the circled portion of FIG. 2.

To transfer the liquid medicament 12 from the vial to a bottle of intravenous solution or the like, the vial is inverted and the covered point 30 of the piercing member 28 is directed against a penetrable portion of the receiving container. As illustrated in FIG. 7, the vial is pushed against the penetrable rubber stopper 70 provided over the mouth of a bottle 72 of parenteral solution 74. As the inverted vial is moved toward the rubber stopper 70, the outer peripheral ring 51 on the upper portion 45 of the elastic sealing member 40 contacts the outside surface of the rubber stopper 70. As the vial is moved further, the point 30 of the piercing member 28 penetrates the elastic sealing member 40. If a groove 65 has been provided in the spike 28, such groove is sealed or covered by a bottom portion 41 of the protective tip 40 before the point 30 completes its penetration through the protective tip 40. Then, the point 30 of the needle 28 continues its penetration directly through the rubber stopper 70 without exposing the needle 30 or the contents of either container to possible contaminants in the atmosphere. The elastic sealng tip 40 or the top portion of the unitary sealing member 58 seals against the receiving container and assists in preventing air from entering the receiving container from around the needle during insertion. The vial is pushed into the stopper 70 until the annular rim 44 of the vial closure 22 approaches the exterior surface of the stopper 70, insuring that the passageway extends into the interior of the bottle 72 of parenteral solution 74. During insertion of the piercing member 28 through the rubber stopper 70, the elastic sealing member 40 is displaced along the piercing shaft 28 and eventually is compressed into the recess 66 provided in the disc 24 so as not to interfere with the penetration of the needle 30.

Typically, a vacuum is maintained in the bottle 72 of parenteral solution 74 sufficient to create a pressure differential between containers. Such pressure differential causes the more positive pressure gas in the vial to respond in an attempt to overcome the vacuum and thereby force the liquid medicament 12 in the vial through the passageway 32. As mentioned above, however, flexible sidewalls may be provided that are manually compressible to assist in such liquid medicament transfer.

The stopper 70 is typically constructed of suitable resilient material that automatically reseals the interior of the bottle 72 from the atmosphere as the piercing member 28 is retracted therefrom. After the vial has been used, it is typically discarded.

It will be understood that the operation of the alternative vial shown in FIG. 6 will function in a slightly different manner. For example, when the vial is inverted for needle 30 insertion, a portion of the contents 12 may flow through the unrestricted passageway 32 into the cavity 90 generally defined by the cylindrical wall of the integral unitary sealing member 58. Such medicament flow is not detrimental because the cavity 90 is sterile. Further, it will be understood that as the needle 30 is pushed against a stopper 70 on a bottle 72 of parenteral solution 74, the needle 30 penetrates the sealing member 58. As the vial is further moved toward the stopper 70, the flexible walls of the sealing member 58 are pushed downwardly along the piercing shaft 28 compressing the cavity area 90. Thus any medicament 12 which may flow into the cavity during inversion of the vial is transferred back into the vial through the appropriately provided vent holes 60 upon progressive insertion of the piercing member 28 through a stopper 70 on the receiving container.

Whereas, the particular embodiments of this invention have been described above for purposes of illustration, it will be apparent to those skilled in the art that numerous variations of the details may be made without departing from the invention.

What is claimed is:

1. An additive vial for transferring a liquid medicament into a container comprising:

a liquid storage container for holding the medicament to be transferred, said container having a neck portion terminating at a bead, said bead having a rim, with the inside dimension of the rim defining the circumference of a mouth of the container;

a disc of rigid material closing the mouth of the container, with a peripheral portion of said disc overlying at least a portion of the rim of the container;

a rigid piercing member extending from a central location of the disc in a direction axially outwardly of the mouth of the container, terminating in a needle point;

an aperture extending from the needle point through a longitudinal axis of the piercing member and continuing through the disc along such axis to define a passageway from the interior of the container to the exterior of the container;

elastic sealing means around and contiguous the outside diameter of the disc overlying at least a portion of the rim of the container, and overlying an outer peripheral portion of the disc;

a protective tip providing a seal over the needle point of the piercing member, said tip being penetrable by the needle point;

a aluminum closure having a removable, outwardly projecting portion extending over and around the piercing member and the protective tip, an annular rim at least partially overlying an outer peripheral portion of the sealing means, and a depending skirt extending downwardly from the annular rim; and wherein a circular portion of the annular rim overlying the outer portion of the disc is indented into the sealing means toward the disc around the circumference of the rim, constricting the elastic sealing means and the disc toward the rim of the container to maintain a seal about the rim of the container.

2. A vial as set forth in claim 1 wherein the liquid storage container comprises a glass bottle.

3. A vial as set forth in claim 1 wherein the liquid storage container is provided with flexible sidewalls.

4. A vial as set forth in claim 1 wherein the liquid storage container has a capacity of 5 to 25 milliliters.

5. A vial as set forth in claim 1 wherein the disc is plastic.

6. A vial as set forth in claim 1 wherein the piercing member is plastic.

7. A vial as set forth in claim 1 wherein the peripheral portion of the disc overlies at least approximately one-third of the surface of the container rim.

8. A vial as set forth in claim 1 wherein an upper portion of the protective tip includes a generally planar central portion and an outer peripheral ring-shaped portion extending around and projecting upwardly of said central portion.

9. A vial as set forth in claim 1 wherein the elastic sealing means and the protective tip are connected by a cylindrical wall to comprise an integral unitary sealing member.

10. A vial as set forth in claim 9 wherein the disc is provided with a vent extending therethrough providing gaseous communication between the interior of the liquid storage container and a cavity located at the exterior of the liquid storage container defined by the cylindrical wall of the integral unitary sealing member.

11. A vial as set forth in claim 1 wherein the elastic sealing means underlies an outer peripheral portion of the disc.

12. A vial as set forth in claim 1 wherein a space is maintained between the outwardly projecting cylindrical portion of the closure and the tip covering the piercing member.

13. A vial as set forth in claim 1 wherein the exterior surface of the disc defines a ring-shaped recess around the piercing member and adjacent thereto, said recess being substantially concentric with the piercing member and providing a space within which the tip is compressed when the piercing member is inserted through a stopper of a container.

14. A vial as set forth in claim 1 wherein the closure is aluminum.

15. A vial as set forth in claim 1 wherein the annular rim of the closure is provided with a circular lance interrupted by a plurality of bridges around the circumference of the closure at the base of the indented portion to permit manual removal of at least an outwardly extending cylindrical portion of the closure, and wherein an air-tight seal is provided under such lance.

16. A vial as set forth in claim 1 wherein the annular rim of the closure is provided with a circular score line around the circumference of the closure at a sufficient depth to permit manual removal of at least an outwardly projecting cylindrical portion of the closure.

17. A vial as set forth in claim 16 wherein the circular score line is provided at the base of the crimped portion.

18. A vial as set forth in claim 1 wherein an outer peripheral portion of the interior surface of the disc is in contact with an inner circumferential portion of the rim of the container.

19. A vial as set forth in claim 1 wherein the needle point is pyramid-shaped, having four, substantially equally spaced, sharp corners.

20. A vial as set forth in claim 1 wherein the rim of the liquid storage container is substantially planar.

21. A vial as set forth in claim 1 wherein liquid impervious means are provided through the piercing member adapted for gas to pass therethrough at pressures less than about five pounds per square inch.

22. A vial as set forth in claim 21 wherein the liquid impervious means comprises a groove extending longitudinally along the axis of the piercing member from the point of the needle to a location below the protective tip, said groove having a diameter of from 0.005 to 0.010 inch.

23. A vial as set forth in claim 1 wherein a bottom portion of the protective tip deflects in a direction away from the needle point when the pressure in the vial exceeds the pressure in a cavity defined between the piercing member and the closure, by less than 30 pounds per square inch to vent a portion of the pressurized contents of the vial into the cavity.

24. A vial as set forth in claim 1 wherein the needle point includes a needle point tip, and the aperture includes a plurality of through slots located near the needle point tip.

25. A vial as set forth in claim 1 wherein the disc and piercing member comprise a one piece construction.

26. An additive vial for transferring a liquid medicament into an evacuated container comprising:

a liquid storage container for holding a medicament to be transferred, said container having a neck portion terminating at a bead having a generally planar rim, with the inside dimension of the rim defining the circumference of a mouth of the container;

a plastic disc concentrically placed over and closing the mouth of the container, with a peripheral portion of said disc overlying at least an inner circumferential portion of the rim of the container;

a generally cylindrical, plastic piercing member of one piece with and extending from a central location of the disc in a direction axially outwardly of the mouth of the container, terminating in a pyramid-shaped needle point;

an aperture extending from a plurality of slots located near the tip of the needle point through a longitudinal axis of the piercing member and continuing through the disc along such axis to define a passageway from the interior of the container to the exterior of the container;

an elastic sealing member around and contiguous the outside diameter of the disc overlying at least a portion of the rim of the container, and overlying an outer peripheral portion of the disc;

a protective elastic tip providing a seal over the needle point of the piercing member, having a generally planar top surface, said tip readily penetrable by the needle point;

an aluminum closure having a manually removable, outwardly projecting cylindrical portion extending over and around the piercing member and the protective tip, an annular rim at least partially overlying an outer peripheral portion of the disc and the sealing member wherein a circular portion of said annular rim is indented into the underlying sealing member, thereby constricting the sealimg member and the disc toward the rim of the container to maintain an air-tight seal thereabout, and a depending skirt extending downwardly from the rim around the outside portion of the elastic sealing member and the container bead.

* * * * *